US005128715A

United States Patent [19]

Furuyama et al.

[11] Patent Number: 5,128,715

[45] Date of Patent: Jul. 7, 1992

[54] PRINT CARTIDGE AND IMAGE FORMING APPARATUS EMPLOYING THE SAME

[75] Inventors: Tetsuya Furuyama; Harufumi Itoh; Kohyu Shigemori; Hideaki Ohike; Tsutomu Tetsuka, all of Kanagawa, Japan

[73] Assignee: Fuji Xerox Co., Ltd., Tokyo, Japan

[21] Appl. No.: 671,104

[22] Filed: Mar. 18, 1991

[30] Foreign Application Priority Data

Mar. 19, 1990 [JP] Japan ..... 2-69207

[51] Int. Cl.[5] ..... G03G 15/00; G03G 21/00

[52] U.S. Cl. ..... 355/200; 29/123; 355/210; 355/211

[58] Field of Search ..... 355/210, 211, 200, 133, 355/202; 29/123, 129.5, 130, 129

[56] References Cited

U.S. PATENT DOCUMENTS

| | | | |
|---|---|---|---|
| 4,344,700 | 8/1982 | Kasama et al. | 355/211 |
| 4,449,809 | 5/1984 | Tamura | 355/210 X |
| 4,591,258 | 5/1986 | Nishino et al. | 355/200 |
| 4,714,337 | 12/1987 | Nishino et al. | 355/200 |
| 4,922,297 | 5/1990 | Kondo | 355/211 |
| 4,975,744 | 12/1990 | Ebata et al. | 355/211 |
| 5,023,660 | 6/1991 | Ebata et al. | 355/200 |
| 5,052,090 | 10/1991 | Kitaura et al. | 29/123 |

FOREIGN PATENT DOCUMENTS

| | | | |
|---|---|---|---|
| 0135879 | 10/1981 | Japan | 355/211 |
| 0021466 | 1/1989 | Japan | 355/210 |
| 0244063 | 9/1990 | Japan | 355/211 |
| 2180795 | 4/1987 | United Kingdom | 355/211 |

*Primary Examiner*—A. T. Grimley
*Assistant Examiner*—Matthew S. Smith
*Attorney, Agent, or Firm*—Finnegan, Henderson, Farabow, Garrett and Dunner

[57] ABSTRACT

A print cartridge having: a housing; an image bearing member rotatably supported on the housing; and a power transmit member for connecting the image bearing member to a drive shaft of metal projected from a body of an apparatus. The print cartridge is withdrawable from the apparatus body. The image bearing member includes a cylindrical drum and a flange fixedly mounted on one end of the drum; the flange having a metal portion provided at a central portion thereof, and a resin portion provided around the metal portion. The metal portion has at an axis of rotation of the flange a shaft support portion for rotatably supporting the drive shaft. The metal portion has a first fitting portion provided on one side thereof directed toward the power transmit member. The power transmit member has a second fitting portion provided on one side thereof directed toward the flange. The first fitting portion and the second fitting portion are fitted together in the direction of rotation of the image bearing member.

4 Claims, 5 Drawing Sheets

PRINT CARTIDGE AND IMAGE FORMING APPARATUS EMPLOYING THE SAME

BACKGROUND OF THE INVENTION

This invention relates to a print cartridge and an image forming apparatus, such as an electrophotographic copying machine and a printer, provided with such a print cartridge.

In a known image forming apparatus, image forming devices, such as a primary static charger, an image exposing portion, a developing device, a transfer static charger and a cleaner, are arranged around the periphery of an image bearing member. After the surface of the image bearing member is electrostatically charged uniformly by the primary static charger, the image is exposed to form an electrostatic latent image, and this electrostatic latent image is developed by the developing device into a visible image. This visible image is transferred to paper by the transfer static charger. The paper is fed to a fixing device for fixing purposes, and the residual toner on the image bearing member is cleaned off by the cleaner.

In such an image forming apparatus, the lifetime of the image bearing member as well as the lifetime of the image forming devices is short, and they need to be periodically inspected, repaired and exchanged. For example, as disclosed in Japanese Laid-Open (Kokai) Patent Application No. 65049/87, an image bearing member and some of image forming devices are integrally formed into a print cartridge, and the print cartridge is removably attached to the body of the apparatus, thereby facilitating inspection, repair and exchange operations.

It is important that the image bearing member of such a print cartridge should be driven at a constant speed during the image forming operation in order to achieve an image formation free from a cyclic deviation. Therefore, it is necessary that a drive shaft supported on the body of the apparatus should be connected to the image bearing member without any misalignment and play.

For example, as shown in the above-mentioned Japanese Laid-Open Patent Application No. 65049/87, a shaft support hole is formed in a flange of the image bearing member at the axis of rotation of the flange, and an engaging hole is formed around the periphery of the shaft support hole, and a power transmit member is mounted on the drive shaft supported on the apparatus body. When the print cartridge is inserted into the apparatus body, the shaft support hole fits on the distal end of the drive shaft, and at the same time a projection of the power transmit member fits in the engaging hole, thereby connecting the image bearing member and the drive shaft together coaxially with each other so that the drive shaft can rotate the image bearing member.

In the above prior art, however, since the flange is integrally formed by a resin, the flange must be increased in diameter because of its insufficient rigidity, and as a result the diameter of the image bearing member can not be made small. Further, the drive shaft is made of iron-type metal whereas the flange is made of a resin, and therefore the difference in thermal expansion coefficient between the two is large. In view of this, if a gap between the drive shaft and the shaft support hole is increased, the play of the image bearing member is increased, so that the print quality is degraded. In contrast, if the gap between the drive shaft and the shaft support hole is decreased, this makes it difficult to remove the print cartridge in a low-temperature environment. Further, in the prior art, since the flange is made entirely of a resin, an earth connection must be taken via the drive shaft. Therefore, an earth slide portion connecting the drive shaft to the apparatus body must be provided, and this earth slide portion need to be periodically exchanged because of its short lifetime.

In order to overcome these problems, it is considered that the flange is made entirely of metal; however, in such a case, the weight of the print cartridge is increased, and a large force is required when exchanging the print cartridge, and also the cost is increased.

SUMMARY OF THE INVENTION

It is an object of this invention to increase the rigidity of a fitting portion of a flange so as to enable an image bearing member to be reduced in diameter.

Another object of the invention is to render a drive shaft and the flange generally equal in thermal expansion coefficient to each other so as to reduce a play to thereby obtain a good print quality.

A further object of the invention is to enable an automatic exchange of an earth slide portion at the time of exchanging a print cartridge.

According to one aspect of the present invention, there is provided a print cartridge comprising a housing; an image bearing member rotatably supported on the housing; a power transmit member for connecting the image bearing member to a drive shaft of metal projected from a body of an apparatus; the print cartridge being withdrawable from the apparatus body;

the image bearing member including a cylindrical drum and a flange fixedly mounted on one end of the drum; the flange having a metal portion provided at a central portion thereof, and a resin portion provided around the metal portion; the metal portion having at an axis of rotation of the flange a shaft support portion for rotatably supporting the drive shaft; the metal portion having a first fitting portion provided on one side thereof directed toward the power transmit member; the power transmit member having a second fitting portion provided on one side thereof directed toward the flange; and the first fitting portion and the second fitting portion being fitted together in the direction of rotation of the image bearing member.

According to another aspect of the invention, there is provided an image forming apparatus comprising (a) an apparatus body; (b) a drive shaft of metal projected from the apparatus body; and (c) a print cartridge including a housing, an image bearing member rotatably supported on the housing, and a power transmit member for connecting the image bearing member to the drive shaft, the print cartridge being withdrawable from the apparatus body;

the image bearing member including a cylindrical drum and a flange fixedly mounted on one end of the drum; the flange having a metal portion provided at a central portion thereof, and a resin portion provided around the metal portion; the metal portion having at an axis of rotation of the flange a shaft support portion for rotatably supporting the drive shaft; the metal portion having a first fitting portion provided on one side thereof directed toward the power transmit member; the power transmit member having a second fitting portion provided on one side thereof directed toward the flange; and the first fitting portion and the second fitting portion being fitted together in the direction of rotation of the image bearing member.

DESCRIPTION OF THE PREFERRED EMBODIMENTS OF THE INVENTION

Figure 3:
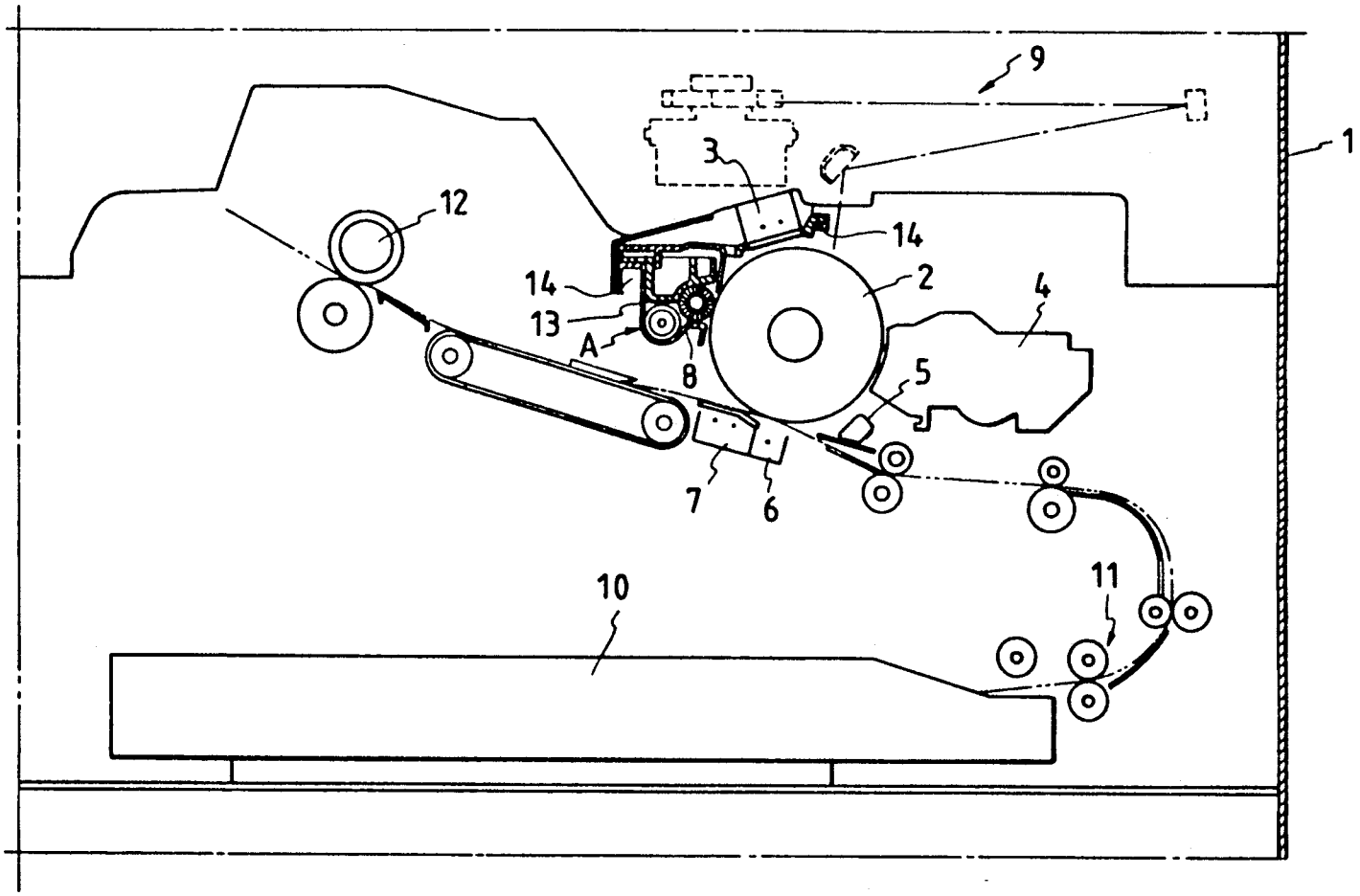
FIG. 3 is a schematic view explanatory of an image forming apparatus.
Figure 4:
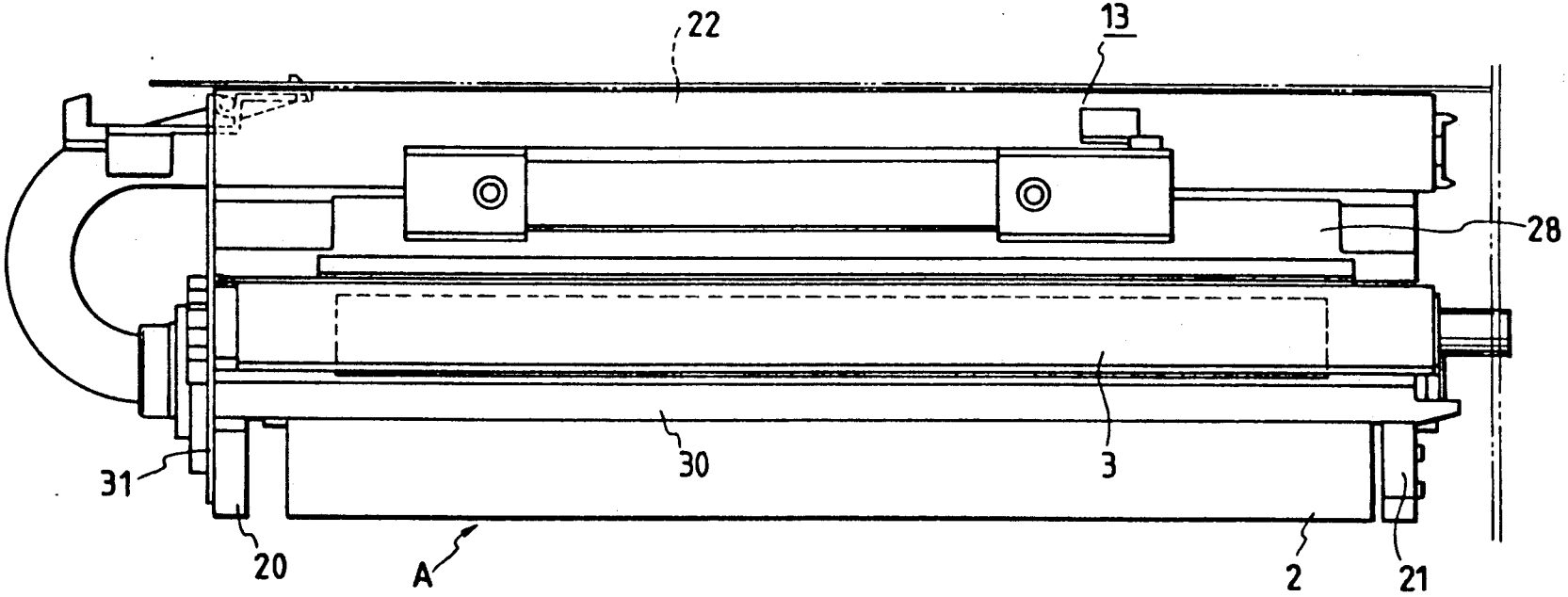
FIG. 4 is a plane view of a print cartridge.
Figure 5:
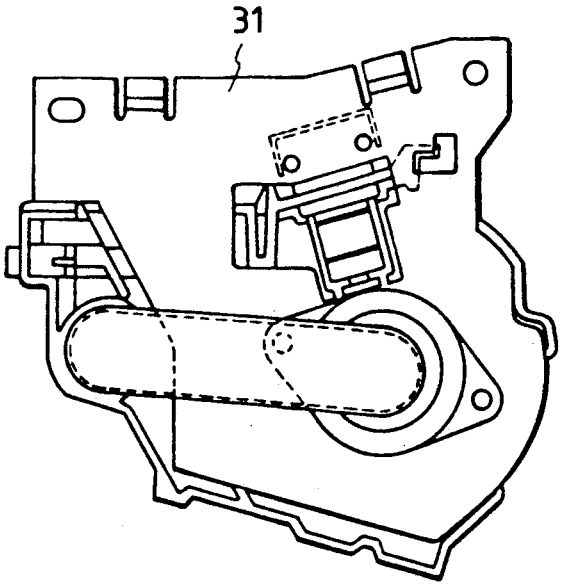
FIG. 5 is a left side view of the print cartridge.
Figure 6:
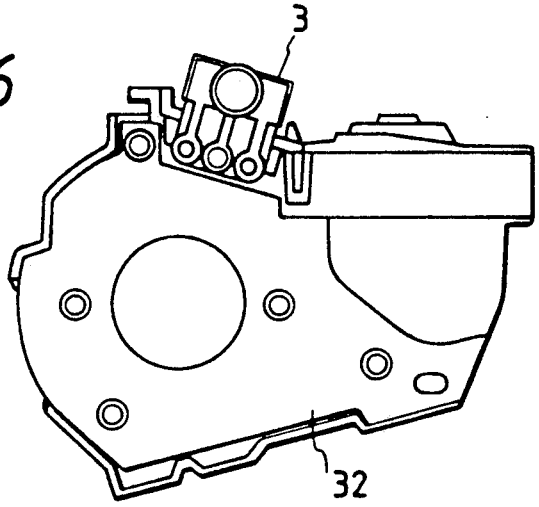
FIG. 6 is a right side view of the print cartridge.
Figure 7:
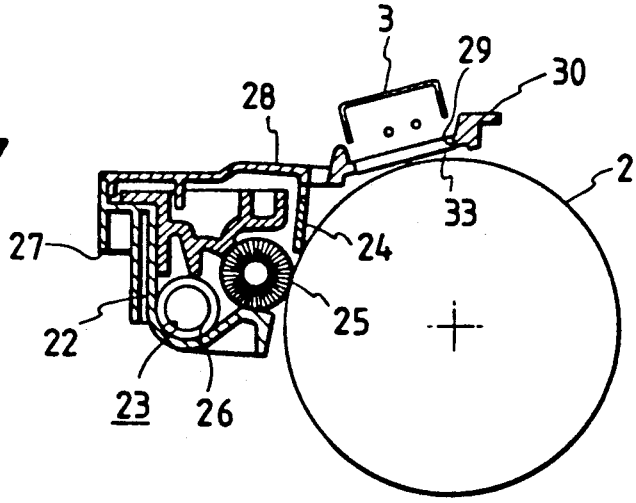
FIG. 7 is a sectional view of the print cartridge.

FIG. 3 is a schematic view explanatory of an image forming apparatus. An image bearing member 2 is provided on an apparatus body 1, and a primary static charger 3, a developing device 4, a pre-transfer static charger 5, a transfer static charger 6, a separating static charger 7, a cleaner 8 and etc., are sequentially arranged around the image bearing member 2. After the surface of the image bearing member 2 is electrostatically charged uniformly by the primary static charger 3, an image exposure is carried out by an image exposing mechanism 9 to thereby form an electrostatic latent image. The electrostatic latent image is developed by the developing device 4 into a visible image. Paper in a paper tray 10 is fed by a paper feed mechanism 11 toward the image bearing member 2, and the above visible image is transferred by the transfer static charger 6 to the paper, and the paper is fed to a fixing device 12 where the paper is fixed to provide a copy.

The image exposing mechanism 9 is of the laser type comprising a laser beam generator, a rotary mirror, and a plurality of mirrors. This image exposing mechanism receives image information from an external office automation device so as to expose an image on the image bearing member.

The image bearing member 2, the primary static charger 3 and the cleaner 8 are mounted on a housing 13 to constitute a print cartridge A. The housing 13 is insertable and withdrawable along guide rails 14 mounted on the apparatus body 1 so that the print cartridge A is withdrawable from and insertable into the apparatus body 1.

As shown in FIGS. 4 to 7, the housing 13 has a one-side plate 20, an other-side plate 21 and a peripheral wall 22. The peripheral wall 22 has a cleaner housing 23, and a cleaning blade 24, a fur brush 25 and an auger 26 are provided in the cleaner housing 23. The peripheral wall 22 has a one-side slide rail 27. A cover member 28 is mounted between the one-side plate 20 and the other-side plate 21 over the upper surfaces thereof. An open window 29 is longitudinally formed through the cover member 28, and a projected end portion of the cover member 28 serves as an other-side slide rail 30. A positioning side plate 31 is mounted on the one-side plate 20, and a side plate 32 is mounted on the other-side plate 21. The primary static charger 3 is mounted on the cover member 28, and a grid 33 of the primary static charger 3 is mounted between the cover member 28 and the upper surfaces of the one-side plate 20 and the other-side plate 21.

With this construction, the one-side slide rail 27 and the other-side slide rail 30 of the housing 13 are slidable respectively along the guide rails 14, provided on the apparatus body 1, in the direction of the axis of the image bearing member 2.

Figure 1:
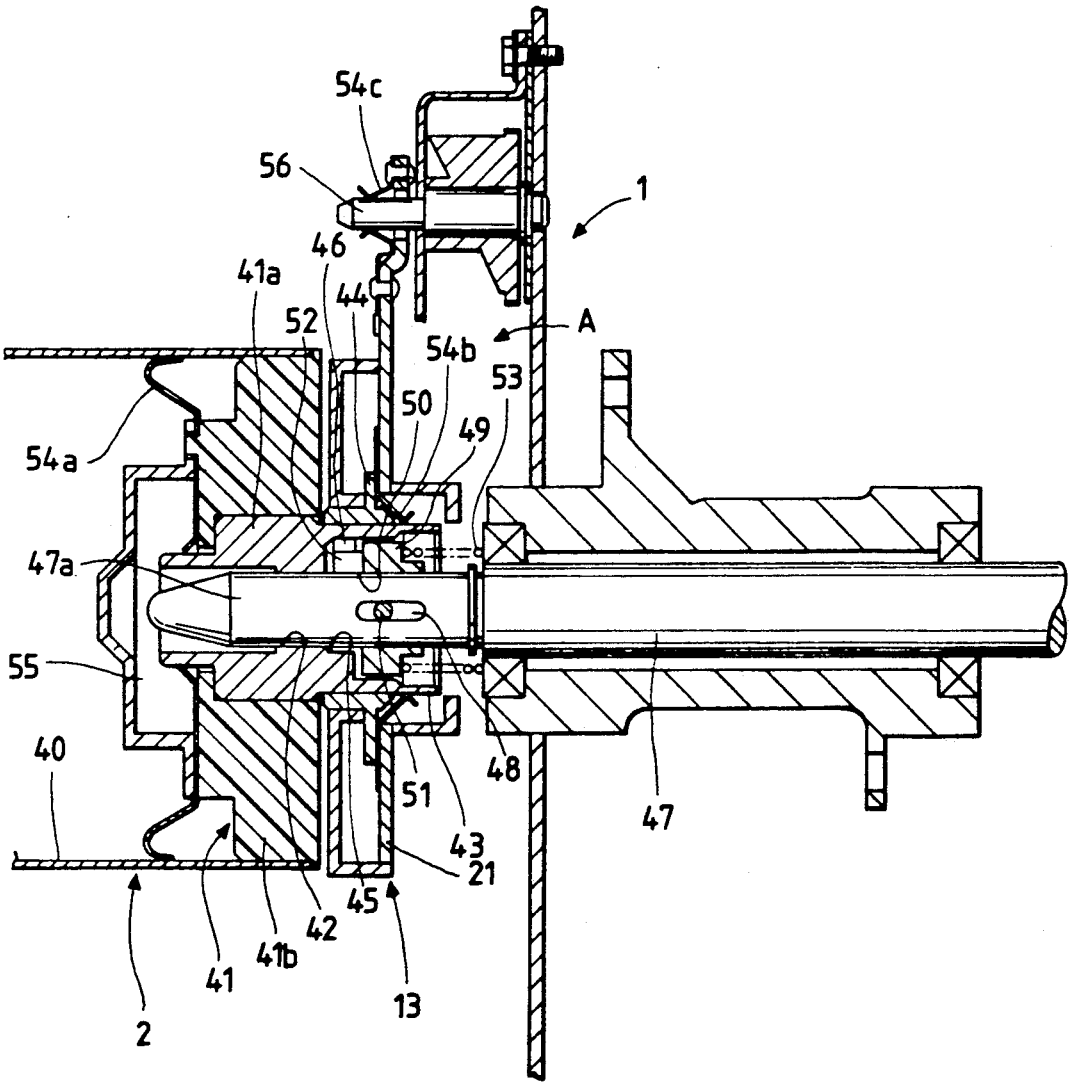
FIG. 1 is a sectional view of a connecting portion between an image bearing portion and a drive shaft of an embodiment of the present invention.
Figure 2:
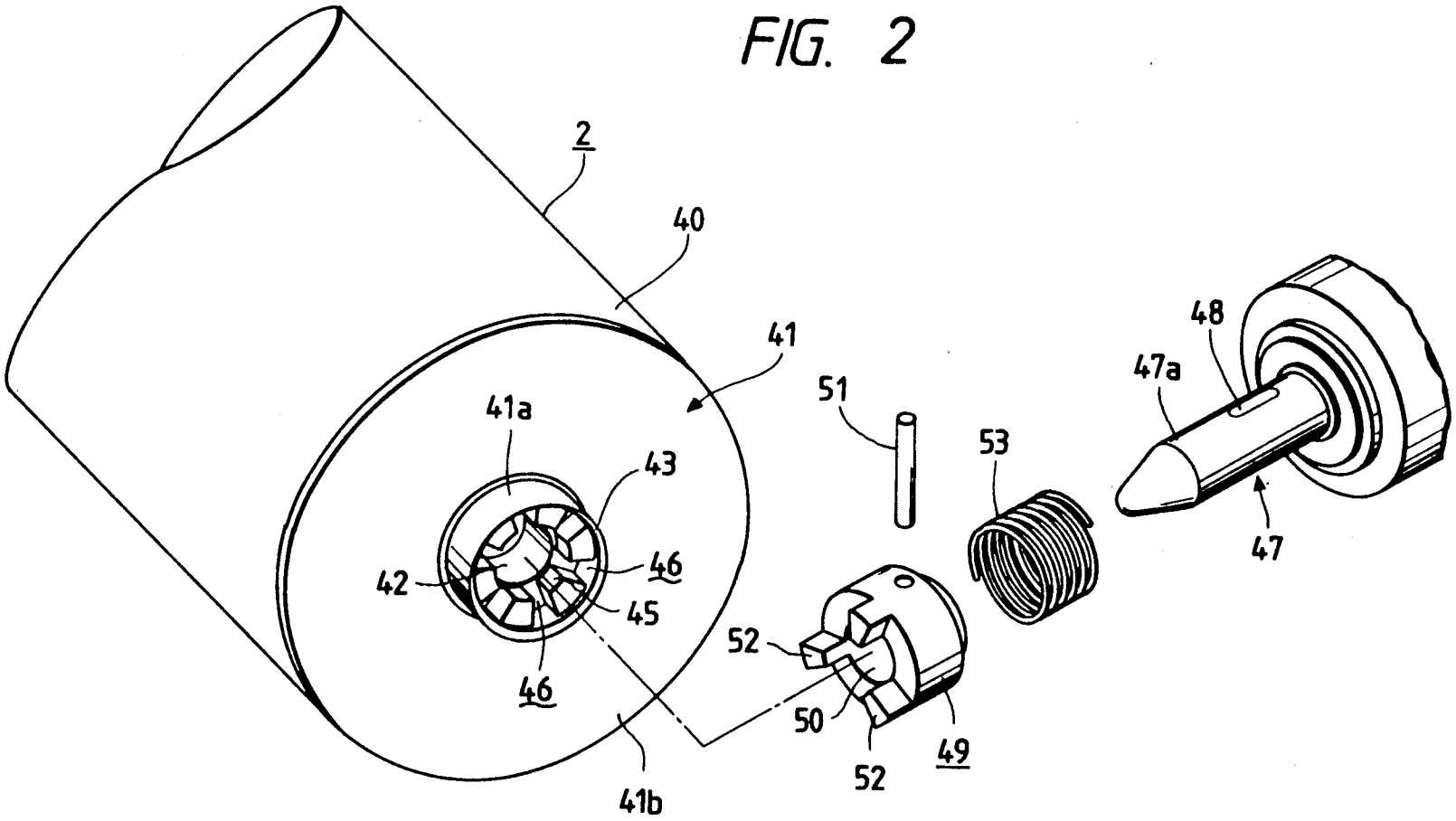
FIG. 2 is a dispensed perspective view of the embodiment shown in FIG. 1.

As shown in FIG. 1, the image bearing member 2 comprises a cylindrical drum 40, and flanges fitted respectively in the opposite ends of the drum 40 to close them. The drum 40 is made of a photosensitive material, and has a metal layer formed on its reverse surface. The flange 41 includes a metal portion 41*a* provided at its central portion, and a resin portion 41*b* provided around the metal portion 41*a*. In this embodiment, although the metal portion 41*a* is press-fitted in the resin portion 41*b*, the metal portion 41*a a* may be insert-molded relative to the resin portion 41*b*. Although the metal portion 41*a* is made of sintered copper alloy, it may be made of any other suitable metal such as stainless steel. The metal portion 41*a* has a shaft support hole 42 whose axis is disposed at the axis of rotation of the flange 41. The metal portion 41*a* has a cylindrical projection 43 formed integrally therewith and disposed coaxially with the shaft support hole 42. The outer surface of the cylindrical projection 43′ constitutes part of the outer surface of the metal portion 41*a*. The projection 43 is rotatably supported on the other-side plate 21 of the housing 13 through a bushing 44. A shaft insertion hole 45 slightly greater in diameter than the shaft support hole 42 is formed within the projection 43. The shaft insertion hole 45 is continuous with the shaft support hole 42, and is coaxial therewith. First fitting portions 46 are formed within the projection 43. As best shown in FIG. 2, the plurality of fitting portions 46 are arranged in a radiating manner, and are circumferentially spaced from one another with respect to a rotation-axis recess.

A drive shaft 47 is made, for example, of iron-type metal, and is rotatably supported on the apparatus body 1. A distal end portion 47*a* of the drive shaft 47 is fitted in the shaft support hole 42 of the flange 41. A slot 48 is radially formed through the drive shaft 47, and extends in the direction of the axis of the drive shaft 47. A power transmit member 49 has a shaft hole 50 formed through a central portion thereof, and the drive shaft 47 is extended through the shaft hole 50. A pin 51 is engaged in the power transmit member 49, and is inserted in the slot 48 of the drive shaft 47 to connect the power transmit member 49 to the drive shaft 47. With this arrangement, the power transmit member 49 is slidable in the direction of the axis of the drive shaft 47 by an amount corresponding to the length of the slot 48, and is prevented from rotation relative to the drive shaft 47. Second fitting portions 52 are formed on one side of the power transmit member 49 facing the flange 41. As best shown in FIG. 2, the plurality of second fitting portions 52 are arranged in a radiating manner, and are circumferentially spaced from one another with respect to a rotation-axis projection. The second fitting portions 52 are fitted respectively in the first fitting portions 46 so as to fix the power transmit member 49 to the flange 41 in the direction of rotation. The power transmit member 49 is urged toward the flange 41 by an urging spring 53.

In order to cause electric charges, accumulated on the reverse surface of the drum 40, to escape to the apparatus body 1, the reverse surface of the drum 40 is electrically connected to the apparatus body 1 by a connecting means via the metal portion 41*a* of the flange 41. This connecting means, for example, includes three metal leaf springs 54*a*, 54*b* and 54*c*. The first leaf spring 54*a* is fixedly held between the resin portion 41*b* of the flange 41 and a cover 55 to connect the reverse surface of the drum 40 to the metal portion 41*a*. The cover 55 isolates the interior of the drum 40 from the shaft support hole 42 to prevent toner, recovered into the drum 40, from leaking to the exterior through the shaft support hole 42. The second leaf spring 54*b* is fixedly held between the other-side plate 21 and the bushing 44 to connect the metal portion 41*a* to the other-side plate 21 of metal. The third leaf spring 54*c* is fixedly mounted on the other-side plate 21 to connect the other-side plate 21 to a shaft 56 of metal. This shaft 56 is mounted on the apparatus body 1 so as to drive the above-mentioned auger 26. Therefore, the electric charges accumulated on the reverse surface of the drum 40 are allowed to escape to the apparatus body 1 via the first leaf spring 54*a*, the metal portion 41*a* of the flange 41, the second leaf spring 54*b*, the other-side plate 21 and the third leaf spring 54*c*.

When the print cartridge A is inserted into the apparatus body 1, the shaft support hole 42 of the flange 41 fits on the distal end portion 47*a* of the drive shaft 47, so that the flange 41 is aligned with the drive shaft, thereby coaxially interconnecting the image bearing member 2 and the drive shaft 47. At this time, the first fitting portions 46 are meshingly fit on the second fitting portions 52 of the power transmit member 49, so that the rotation of the drive shaft 47 can be transmitted to the flange 41 through these meshed portions, thereby rotating the image bearing member 2.

If the first fitting portions 46 are out of phase with and fail to fit on the second fitting portions 52 of the power transmit member 49 when the print cartridge A is to be inserted into the apparatus body 1, the front end of the projection 43 of the flange 41 is, upon insertion of the print cartridge A, engaged with the second fitting portions 52 of the power transmit member 49 to urge the power transmit member 49 to slide to a predetermined position against the bias of the urging spring 53, so that the print cartridge can be attached to the apparatus body. In this condition, when the drive shaft 47 is slightly rotated, the first fitting portions 46 are brought into registry with the second fitting portions 52, and the urging spring 53 causes the power transmit member 49 to slide, so that the first fitting portions 46 and the second fitting portions 52 are fittingly engaged with each other.

What is claimed is:

1. A print cartridge, being withdrawable from an apparatus body, comprising: a housing; an image bearing member rotatably supported on said housing; and a power transmit member for connecting said image bearing member to a drive shaft of metal projected from a body of said apparatus;

wherein said image bearing member includes a cylindrical drum and a flange fixedly mounted on one end of said drum; said flange has a metal portion provided at a central portion thereof, and a resin portion provided around said metal portion; said metal portion has at an axis of rotation of said flange a shaft support portion for rotatably supporting said drive shaft; said metal portion has a first fitting portion provided on one side thereof directed towards said power transmit member; said power transmit member has a second fitting portion provided on one side thereof directed toward said flange; and said first fitting portion and said second fitting portion are fitted together in the direction of rotation of said image bearing member; and further comprising a connecting means for electrically connecting a reverse surface of said drum to said apparatus body via said metal portion.

2. A print cartridge according to claim 1, in which said metal portion is press-fitted in said resin portion.

3. A print cartridge according to claim 1, in which said metal portion is insert-molded in said resin portion.

4. An image forming apparatus comprising:

(a) an apparatus body;

(b) a drive shaft of metal projected from said apparatus body; and (c) a print cartridge including a housing, an image bearing member rotatably supported on said housing and a power transmit member for connecting said image bearing member to said drive shaft, said print cartridge being withdrawable from said apparatus body;

wherein said image bearing member includes a cylindrical drum and a flange fixedly mounted on one end of said drum; said flange has a metal portion provided at a central portion thereof, and a resin portion provided around said metal portion; said metal portion has at an axis of rotation of said flange a shaft support portion for rotatably supporting said drive shaft; said metal portion has a first fitting portion provided on one side thereof directed toward said power transmit member; said power transmit member has a second fitting portion provided on one side thereof directed toward said flange; and said first fitting portion and said second fitting portion are fitted together in the direction of rotation of said image bearing member; and further comprising a connecting means for electrically connecting a reverse surface of said drum to said apparatus body via said metal portion.

* * * * *

UNITED STATES PATENT AND TRADEMARK OFFICE

CERTIFICATE OF CORRECTION

PATENT NO. : 5,128,715

DATED : July 07, 1992

INVENTOR(S) : Tetsuya Furuyama et al.

It is certified that error appears in the above-identified patent and that said Letters Patent is hereby corrected as shown below:

On the title page, item [54] and in column 1, line 2, in the title change "CARTIDGE" to --CARTRIDGE--.

Signed and Sealed this

Twenty-eighth Day of September, 1993

Bruce Lehman

*Attest:*

BRUCE LEHMAN

*Attesting Officer*

*Commissioner of Patents and Trademarks*